United States Patent [19]

Petursson

[11] 4,085,469

[45] Apr. 25, 1978

[54] WASTE CONTROL WITH REPLACEABLE CABLE

[76] Inventor: Sigurdur G. Petursson, 2169 Linby Street, Mississauga, Ontario, Canada

[21] Appl. No.: 723,441

[22] Filed: Sep. 15, 1976

[51] Int. Cl.[2] ..... E03C 1/24; E03C 1/22

[52] U.S. Cl. ..... 4/199; 4/201; 4/204; 4/206

[58] Field of Search ..... 4/199, 204, 203, 198, 4/197, 206, 200, 201

[56] References Cited

U.S. PATENT DOCUMENTS

| | | | |
|---|---|---|---|
| 1,807,117 | 5/1931 | Kaufman | 4/199 |
| 1,867,725 | 7/1932 | Brotz | 4/199 |
| 2,017,416 | 10/1935 | Mallet et al. | 4/199 |
| 2,059,120 | 10/1936 | Kreuzer et al. | 4/199 |
| 2,085,876 | 7/1937 | Steen | 4/199 |
| 2,184,001 | 12/1939 | Nystrom | 4/199 |
| 2,234,048 | 3/1941 | Groen | 4/199 |

*Primary Examiner*—Henry K. Artis

[57] ABSTRACT

A drain plug in the outlet of a plumbing fixture such as a lavatory basin or bath is connected with the waste control handle by means of a flexible cable loosely contained within a flexible tube extending through the overflow pipe and the drain pipe, to obviate the need for seals in conjunction with the waste actuator system, and permitting ready replacement of the cable and tube. A plastic tube used in combination with a plastic cable in loose fitting relation therein provides a low cost and practical combination, having a simple attachment clip to permit ready installation or replacement.

8 Claims, 7 Drawing Figures

WASTE CONTROL WITH REPLACEABLE CABLE

This invention is directed to an improved waste control and in particular to a replaceable control cable/tube combination particularly suited for baths and hand wash basin fixtures.

In the operation of mechanical linkages used to control drain stoppers in plumbing fixtures many and varied mechanical linkages have been utilised, with varying degrees of success.

One prior arrangement in U.S. Pat. No. 3,099,019 Tiller, July 30th, 1963, is directed to a Bowden cable type of arrangement having a flexible rod contained within a tube extending from the location of the waste actuating handle to a point adjacent the bottom of the drain plug. Owing to the passage of the control cable combination of this prior art arrangement through a lower wall of the fixture it is necessary to provide a seal arrangement in the wall aperture to preclude leakage of waste water past the outside cable cover. The flexible rod is not sealed in relation to its guide tube, the arrangement depending upon the shielding or umbrella effect of the skirt of the waste plug to substantially preclude the entry of water into the tube. The mouth of the tube is extended upward by the provision of an adaptor located in sheltered relation beneath the waste plug skirt.

The tube of Tiller is secured by means of a threaded adaptor extending through a sealing nut combination in the fixture wall.

Under operating conditions of this prior arrangement if friction between the rod and guide tube due to the relative motion therebetween erode the tube wall at the lower bend thereof to create a penetration therethrough lying outside the confines of the fixture then a potential leak is created. Replacement of the tube requires breaking and renewal of the threaded seal.

In the case of Klein, U.S. Pat. No. 2,137,496, issued Nov. 22nd, 1938, use is made of a construction comprising a central flexible steel wire or cable guided within a coiled outer cable of the so-called Bowden cable type and protected against leakage of liquid inwardly thereto by a surrounding pipe, having a protective end cap to preclude leakage of water inwardly between the wire and its double outer covering. This arrangement extends within the waste pipe overflow pipe of the fitting to the operating handle. The cable is positioned beneath the stopper by a bridge piece secured thereto.

Known prior arrangements all appear to require adjustment of the cable attachment, in order to achieve requisite opening motion and satisfactory closure, at the time of installation or replacement, whereas the present invention requires no such adjustmant. For this and other reasons, the prior art arrangements do not appear to have achieved wide-spread commercial success.

In accordance with the present invention a flexible cable arrangement comprising a flexible inner cable located within a semi-rigid outer cover is located within the plumbing line, utilising the overplow pipe and the drain pipe of the plumbing fixture as a cable run within which the cable is located, at least below the water line of the fixture, so that water leaking into the interior of the cable may not pass to the exterior of the fixture as a leak, while the provision of the sealing arrangement for the cable both interiorly in relation to the inner cable and exteriorly in relation to the cable cover and its path of location, is made unnecessary.

It has been found that by selecting a cable-tube combination of suitable relative dimensions it is possible to provide an operating cable embodying the present invention wherein the cable may be replaced without total disassembly of the fixture. In practice a plastic tube having an internal diameter of 75 mil (0.075") in combination with a cable of approximately 0.060"outside diameter permits ready insertion of a replacement cable/tube combination with minimum inconvenience. The clearance between cable and tube permits the formation of requisite bends without the occurance of seizure of the cable by the tube. The presence of the cable within the tube precludes local collapse of the tube wall into the formation of a kink which otherwise could trap the cable.

In the event of the breakage of the cable or tube in operation, it is a relatively simple operation to insert a replacement cable/tube assembly in the overflow and drain lines in situ and restore the function. The use of a cable of hollow plastic tubing in combination with quick release means permitting detachment and reattachmemt from within the basin greatly facilitates fastening the cable ends to the respective components. Utilisation of plastic components permits heat sinking, crimping or swaging techniques to the user in manufacture of components to achieve low costs.

One advantage of selecting plastic tube is the fact that it is very flexible and adaptable to press fitting connecting. This greatly simplifies the matter of attachment to the spider and cross bar end fittings as compared with Tiller or Klein. The adoption of clip-in arrangements for securing the tube ends, and their loaction with access from within the basin greatly facilitates installation and replacement.

In addition to characteristics of simplicity, reliability and ready replacement, the arrangement also is of low cost using materials that are readily available.

The provision of a wear pin pressed into the cable and the lifter swaged to the cable prevents accidental or malicious withdrawal of the cable through the tube.

Certain embodiments of the invention are described, 25 reference being made to the accompanying drawings, wherein.

Figure 1:
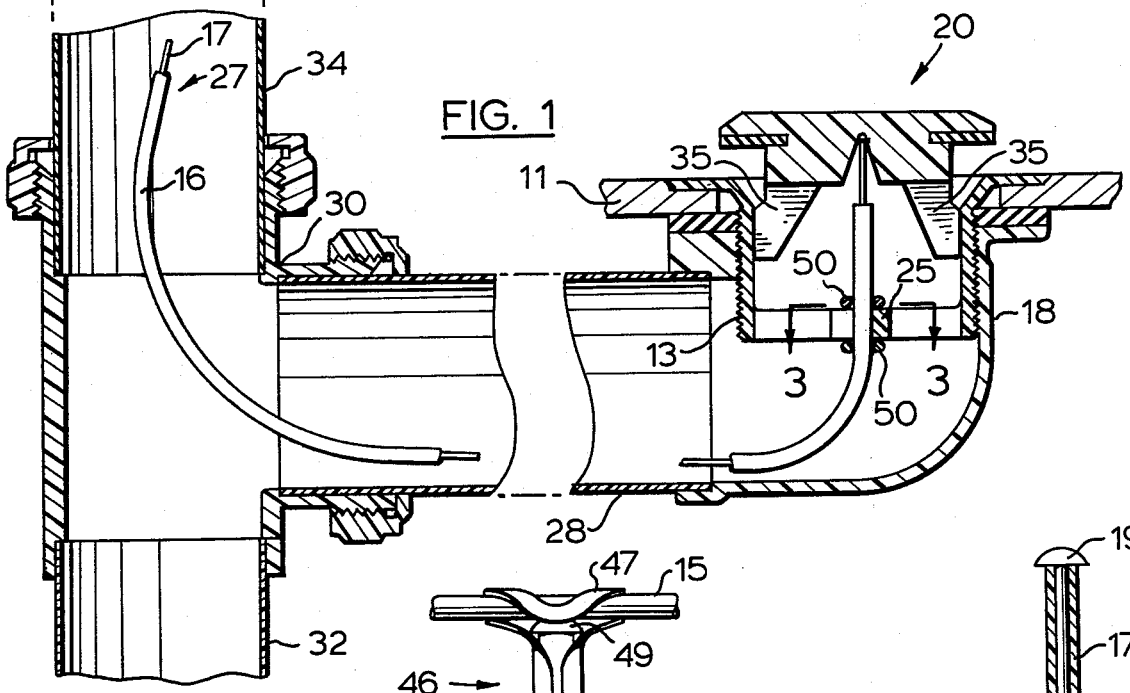
FIG. 1 is a vertical section through a portion of plumbing fixture embodying an actuator mechanism in accordance with the present invention.

Referring to FIG. 1, the system 10 comprises a plumbing fixture such as a bath tub or a hand washbasin referred to in the trade as a lavatory, having a wall 11.

In the illustrated system 10 (depicting a bath tub installation) there is provided a drain pipe 28 secured to a tee piece 30 from which a drain pipe 32 extends downwardly. An overflow drain 34 has an overflow escutcheon 12, as is well known in the art, covering an overflow aperture 112 in the wall 11 of the fixture, to which an overflow elbow 34' is sealed.

A strainer basket 13 is secured in well known fashion by way of a threaded elbow 18 to which the drain pipe 28 is connected.

The basket 13 includes a central spider having arms which carry a central boss 25 over which a stopper 20 is centred.

In accordance with the present invention a control assembly 27 comprising an outer tube 16 and inner cable 17 extends between the boss 25 and a control handle assembly 29 mounted on the escutcheon 12.

The escutcheon 12 has an aperture through which extends an upper straight portion 14 of the handle spindle 15 to which the actuator knob 21 is secured. A stop member 22 limits the upward or withdrawing movement of the knob 21. The handle spindle 15 could be so shaped to stop against a bridge means 31 instead.

The upper end of tube 16 is secured by way of insertion in clipped-in relation within a shaped recess 23 in bridge means 31. The bridge means 31 is secured across aperture 112 by way of screws 33 secured to opposite sides of the overflow elbow 34'. A screw 37 for the escutcheon 12 also is threadedly attached to the bridge means 31.

Figure 6:
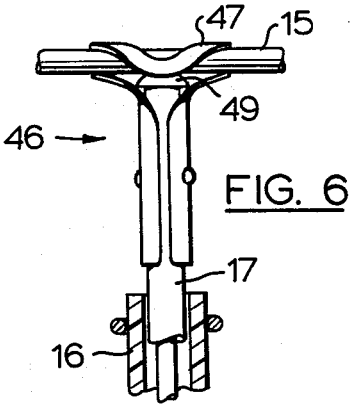
FIG. 6 is a detail of the cable and tube upper end.
Figure 7:
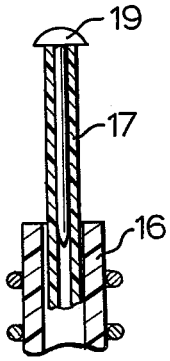
FIG. 7 is a detail of the cable and tube lower end.

An aperture 39 in bridge means 31 serves as a guide for a straight tail piece or guide portion 41 of the spindle 15 to ensure straight reciprocating motion thereof upon actuation of the knob 21. Connecter means 46 (see FIG. 6.) illustrated as having a bifurcated portion 47 through which handle spindle 15 is passed, is staked to the inner cable 17 and further secured by means of a pin 49 inserted into the interior of cable 17, which also adds stiffness to the inner cable 17 at this point.

A stop pin 19 is secured to the lower end of cable 17 by insertion therein, to impart stiffness and a hard wearing surface thereto. The pin 19 has an outer head diameter greater than the internal diameter of the tube 16, to preclude withdrawal of the cable end and pin 19 through the pipe 16.

The upper head end of pin 19 is received in a central recess of the stopper 20.

Figure 2:
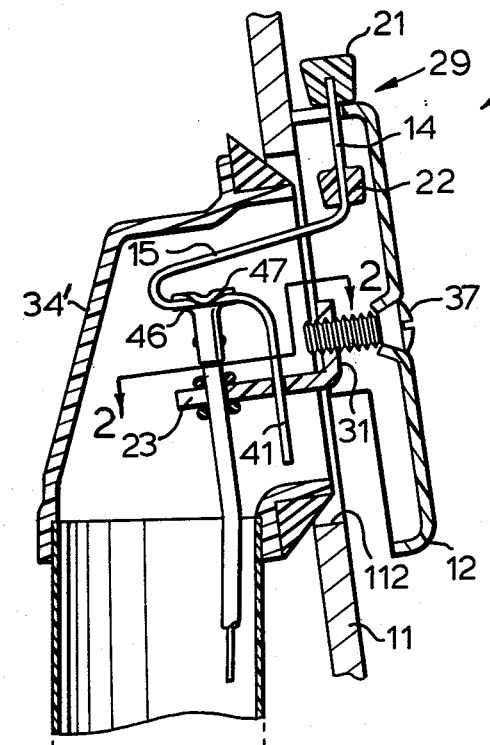
FIG. 2 is a view at 2—2 of FIG. 1
Figure 2:
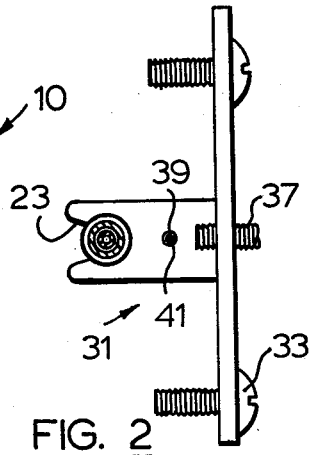
Figure 3:
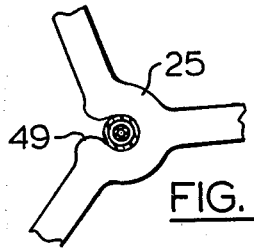
FIG. 3 is a view at 3—3 of FIG. 1.
Figure 4:
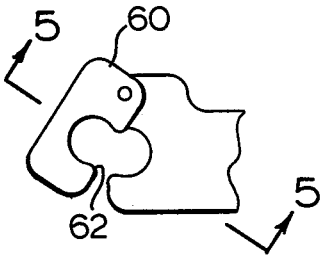
FIG. 4 is a view corresponding to FIG. 2 of a portion of an alternative clip-in attachment.
Figure 5:
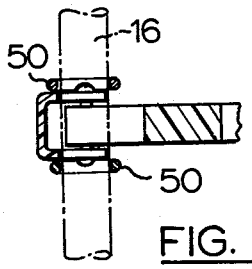
FIG. 5 is a view at 5—5 of FIG. 4

The lower end of tube 16 is axially secured (FIG. 3) by pressed insertion within a recess 49 in the spider 25. Also shown are clip-like annular ring 50 of wire or plastic which in some instances are used to provide positive axial fixing of the tube 16. In the FIG. 5 embodiment is shown an alternative clamping clip form for securing the tube 15, having a pivotal clip portion 60 having a sharp edged recess 62 to grip cable 16 (shown in phantom), the clip portion 60 being functionally enlarged to the bridge means 31 or boss 25. The cable 16 may be readily detached or re-engaged, using a simple tool as a pry if desired. Similarly a separate speed clip type of fastening of similar geometry may be used.

The wing portions 35 or ribs of the stopper 20 serve to centre the stopper 20 in the basket 13.

The greater length of cable 17 related to the tube 16 permits relative displacement of cable 17 along the tube 16, in response to actuation of the knob 21, thereby reaising or lowering the stopper relative to the drain seat.

It has been found that nylon or other suitable plastic materials can provide approximately one pound lifting force necessary on occasion to displace the stopper in an opening mode, even when heated by hot water. Polyethlene or ABS plastic are not generally considered suitable, owing to insufficient hot strength.

Due to the predetermined gauged lengths of the tube and cable, there is no need to provide adjustment in the installation. However, in the extreme condition that cable shortening is desired, withdrawal of the stop pin 19 permits the end of cable 17 to be clipped short and the pin 19 replaced.

What I claim by Letters Patent of the United States is:

1. In combination with a water fillable opentopped ablution receptacle having a drain pipe depending in sealed relation from a drain opening in the receptacle to connect with a drainage system when installed, a drain operating control having a handle secured to the receptacle, a flexible tube having one end secured in fixed relation adjacent said handle, clip means accessible through said opening removeably securing the remote end of said tube adjacent said drain opening, and a resilient cable having one end thereof removeably connected to said control handle, extending in slideable relation through said tube, the outside diameter of said cable being sufficiently smaller than the inside diameter of said tube, to permit bending of the tube in a desired path conforming relation without entrapment of the cable therein, the other end of said cable extending upwardly from the tube being moveable vertically relative thereto in response to motion of said control handle to raise and lower a stopper located in flow controlling relation in said drain opening.

2. The combination of claim 1 wherein said tube is a plastic tube.

3. The combination of claim 2 wherein said cable is a hollow plastic cable.

4. The combination of claim 1 wherein said tube is located within an overflow pipe connecting an overflow vent from said receptacle with said drain pipe.

5. The combination of claim 1 wherein said clip means includes a cross piece in transversely extending relation beneath said opening.

6. The combination of claim 5 including a transversely accessible trapping aperture in said cross piece to receive said flexible tube in axially secured removeable relation therein.

7. The combination of claim 5 said flexible tube having at least one protruberence on the outer surface thereof adjacent said remote end for engagement in cooperating relation with said clip means.

8. The combination of claim 1 having a removeable bridge means secured across an aperture in the wall of said receptacle adjacent said control, clip means securing said one end of said tube to the cross piece in axially secured relation, handle guide spindle means secured to said handle extending in slidable relation through an aperture in said bridge means to guide the handle in linear displaceable relation therewith, and a connector securing said cable end to a portion of said handle guide spindle to transmit linear displacement thereof to said cable.

* * * * *